US011270581B1

(12) United States Patent
Palumbo et al.

(10) Patent No.: US 11,270,581 B1
(45) Date of Patent: Mar. 8, 2022

(54) VEHICLE QUEUE LENGTH AND TRAFFIC DELAY MEASUREMENT USING SENSOR DATA FOR TRAFFIC MANAGEMENT IN A TRANSPORTATION NETWORK

(71) Applicant: ITERIS, INC., Santa Ana, CA (US)

(72) Inventors: Allison C. Palumbo, Round Rock, TX (US); Nader Ayoub, Austin, TX (US); Michael T. Whiting, Ranch Santa Margarita, CA (US)

(73) Assignee: ITERIS, INC., Santa Ana, CA (US)

( * ) Notice: Subject to any disclaimer, the term of this patent is extended or adjusted under 35 U.S.C. 154(b) by 0 days.

(21) Appl. No.: 17/410,976

(22) Filed: Aug. 24, 2021

(51) Int. Cl.
*G08G 1/08* (2006.01)
*G08G 1/01* (2006.01)

(52) U.S. Cl.
CPC ..... *G08G 1/08* (2013.01); *G08G 1/0145* (2013.01)

(58) Field of Classification Search
CPC ..... G08G 1/08; G08G 1/082; G08G 1/0145
USPC ..... 340/907
See application file for complete search history.

(56) References Cited

U.S. PATENT DOCUMENTS

2008/0204277 A1* 8/2008 Sumner ..... G08G 1/08 340/910
2021/0375127 A1* 12/2021 Kalabic ..... G08G 1/0145

* cited by examiner

*Primary Examiner* — Joseph H Feild
*Assistant Examiner* — Sharmin Akhter
(74) *Attorney, Agent, or Firm* — Lazaris IP

(57) ABSTRACT

A framework for precision traffic analysis estimates vehicle queue length at an observed roadway and calculates vehicle delay for improvements in traffic flow efficiency at a corresponding traffic intersection. The framework identifies a traffic detection area for a roadway at or near the traffic intersection and detects objects in the traffic detection area from sensors located proximate to the roadway. The framework then analyzes sensor data to determine the efficiency of the traffic network and to determine adjustments to timing of various phases of the signal timing plan for the traffic intersection.

29 Claims, 5 Drawing Sheets

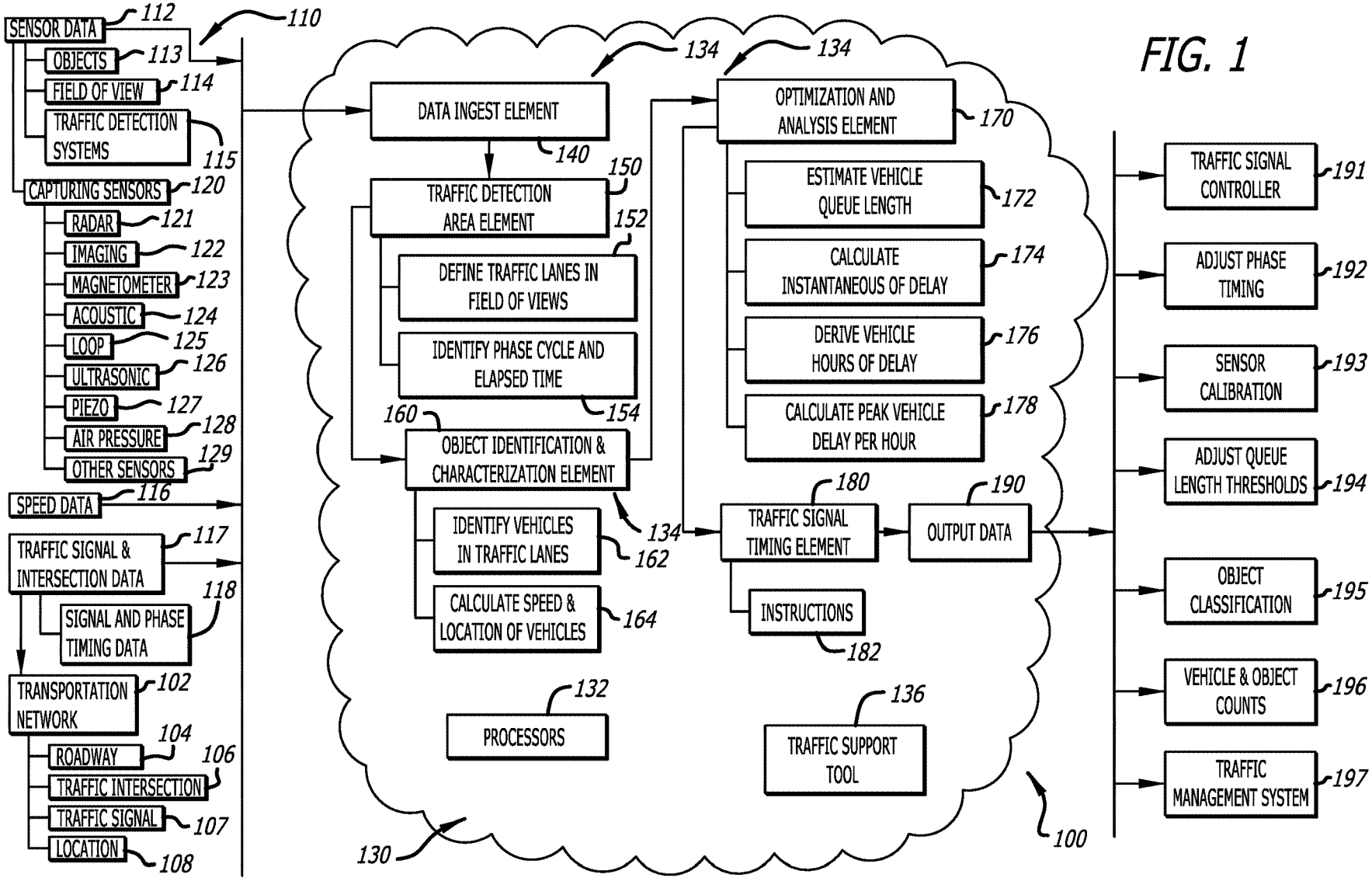
FIG. 1
TRAFFIC SIGNAL CONTROLLER
191
ADJUST PHASE TIMING
192
SENSOR CALIBRATION
193
ADJUST QUEUE LENGTH THRESHOLDS
194
OBJECT CLASSIFICATION
195
VEHICLE & OBJECT COUNTS
196
TRAFFIC MANAGEMENT SYSTEM
197
100
OPTIMIZATION AND ANALYSIS ELEMENT
170
ESTIMATE VEHICLE QUEUE LENGTH
172
CALCULATE INSTANTANEOUS OF DELAY
174
DERIVE VEHICLE HOURS OF DELAY
176
CALCULATE PEAK VEHICLE DELAY PER HOUR
178
OUTPUT DATA
190
TRAFFIC SIGNAL TIMING ELEMENT
180
INSTRUCTIONS
182
TRAFFIC SUPPORT TOOL
136
134
134
DATA INGEST ELEMENT
140
TRAFFIC DETECTION AREA ELEMENT
150
DEFINE TRAFFIC LANES IN FIELD OF VIEWS
152
IDENTIFY PHASE CYCLE AND ELAPSED TIME
154
OBJECT IDENTIFICATION & CHARACTERIZATION ELEMENT
160
134
IDENTIFY VEHICLES IN TRAFFIC LANES
162
CALCULATE SPEED & LOCATION OF VEHICLES
164
PROCESSORS
132
130
110
SENSOR DATA
112
OBJECTS
113
FIELD OF VIEW
114
TRAFFIC DETECTION SYSTEMS
115
CAPTURING SENSORS
120
RADAR
121
IMAGING
122
MAGNETOMETER
123
ACOUSTIC
124
LOOP
125
ULTRASONIC
126
PIEZO
127
AIR PRESSURE
128
OTHER SENSORS
129
SPEED DATA
116
TRAFFIC SIGNAL & INTERSECTION DATA
117
SIGNAL AND PHASE TIMING DATA
118
TRANSPORTATION NETWORK
102
ROADWAY
104
TRAFFIC INTERSECTION
106
TRAFFIC SIGNAL
107
LOCATION
108

174

| Lane | Phase | Veh Stopped | Veh <5mph | Total Veh | x 15 sec (veh-sec) |
|---|---|---|---|---|---|
| Lane 3 | 2 | 2 | 1 | 3 | 45 |
| Lane 2 | 2 | 1 | 1 | 2 | 30 |
| Lane 1 | 5 | 0 | 0 | 0 | 0 |

| Lane | Phase | Veh Stopped | Veh <5mph | Total Veh | x 15 sec (veh-sec) |
|---|---|---|---|---|---|
| Lane 3 | 2 | 5 | 0 | 5 | 75 |
| Lane 2 | 2 | 2 | 1 | 3 | 45 |
| Lane 1 | 5 | 0 | 1 | 1 | 15 |

| Lane | Phase | Veh Stopped | Veh <5mph | Total Veh | x 15 sec (veh-sec) |
|---|---|---|---|---|---|
| Lane 3 | 2 | 7 | 0 | 7 | 105 |
| Lane 2 | 2 | 4 | 1 | 5 | 75 |
| Lane 1 | 5 | 2 | 0 | 2 | 30 |

| Lane | Phase | Veh Stopped | Veh <5mph | Total Veh | x 25 sec (veh-sec) |
|---|---|---|---|---|---|
| Lane 3 | 2 | 9 | 0 | 9 | 135 |
| Lane 2 | 2 | 6 | 0 | 6 | 90 |
| Lane 1 | 5 | 2 | 1 | 3 | 45 |

176

| Minutes | Veh-seconds delay | | Cumulative (v-s) | | Veh-hrs delay | |
|---|---|---|---|---|---|---|
| | Phase 2 | Phase 5 | Phase 2 | Phase 5 | Phase 2 | Phase 5 |
| 0.25 | 75 | 0 | | | | |
| 0.50 | 120 | 15 | 195 | 15 | 0.05 | 0.00 |
| 0.75 | 180 | 30 | 300 | 45 | 0.08 | 0.01 |
| 1.00 | 225 | 45 | 405 | 75 | 0.11 | 0.02 |
| ... | ... | ... | ... | ... | ... | ... |
| 15.00 | 75 | 15 | 5400 | 1080 | 1.5 | 0.3 |

VEHICLE QUEUE LENGTH AND TRAFFIC DELAY MEASUREMENT USING SENSOR DATA FOR TRAFFIC MANAGEMENT IN A TRANSPORTATION NETWORK

FIELD OF THE INVENTION

The present invention relates generally to the field of traffic management. More specifically, the present invention relates to systems and methods of observing and measuring a traffic queue length and estimating resulting vehicle delay at an observed roadway to assess performance of a traffic network and adjust traffic signal timing, using data derived from various sensors.

BACKGROUND OF THE INVENTION

There are many traffic detection systems in the existing art. Conventional systems typically utilize one or more types of sensors, either within a roadway itself, or positioned at a roadside location or on traffic lights or signals proximate to the roadway, to observe traffic patterns and detect specific objects. The most common type of sensors used are inductive coils, or loops, embedded in a roadway surface. Other existing and conventional traffic detection systems utilize video cameras, radar sensors, acoustic sensors, or magnetometers, which are placed in the roadway itself, at the side of the roadway, or positioned higher above traffic to observe and detect vehicles and other objects within a desired area. Each of these types of sensors provide information used to determine a presence of vehicles and objects in specific lanes, typically at or near traffic intersections, and this information is provided to, and used by, traffic signal controllers for proper actuation.

There are also many existing approaches available to traffic engineers for monitoring traffic conditions and counting the number of vehicles present at a roadway or intersection. These include using traffic detection systems, such as for example placing inductive loops at various setback distances and counting vehicles proximate to the loops, information derived from calculations and analysis of data collected by other sensors such as those referenced above, and human visual observation.

Traffic delay is generally considered to be additional travel time experienced by a driver, passenger, or pedestrian. For roadways or intersections that are signalized, traffic delay that a motorist experiences is attributable to the presence of the traffic signal, and conflicting traffic, and includes time spent decelerating, in queue, and accelerating. At such signalized roadways intersections, phase timing of traffic signals occurs in cycles that are often designed to alleviate congestion and promote optimal traffic flow while safely moving conflicting traffic through the intersection. There are many methods of cycling phases to service vehicles on each approach at intersections, but traffic patterns change throughout the course of a day and can result in inefficient operation where the timing of phases does not accommodate the current traffic demand. For example, when a traffic signal changes indication from green to yellow and then finally to red, a queue of traffic begins to build in each lane. For efficient operation, the green phase time should be long enough to ensure all vehicles depart the approach. If the green time is set too long, then the traffic intersection may be inefficient because green time is wasted on one approach while vehicles are waiting to be serviced on another approach. If the green time is set too short, then unserviced vehicles will form a queue of traffic at the end of the phase.

Traffic patterns may become disrupted and have unanticipated changes for a variety of reasons such as the presence of slower moving users including pedestrians or cyclists, first responder or emergency vehicle interruptions, transit signal priority operations for mass transit vehicles, and planned and unplanned events that change the routes that drivers use. Many of these situations cannot be predicted and proactively provided for, and each can cause traffic delay, resulting in traffic network performance inefficiencies.

Some patterns, however, can be predicted through data and trend analysis, such as times of high roadway usage, for example 'rush' hour occurrences where congestion is more prevalent. At such times, different signal phase timing may be necessary to maintain an optimized flow of traffic. Knowledge of when and where the increase in traffic congestion is occurring or will occur enables traffic engineers to program time-of-day timing plan changes into relevant traffic signal controllers to cope with changes in traffic flow.

Counts of vehicles stopped at such signalized roadways and intersections can determine the presence of a traffic queue, and are an indication of traffic congestion and are one existing approach to ascertaining delay and its effects. Using counts of stopped vehicles as a measure of congestion however are problematic for traffic engineers, because a queue may actually include vehicles with speeds that are impeded by the traffic signal, and therefore includes more than just vehicles that are stopped waiting for the signal indication to change. Queues may therefore include slow-moving vehicles, such as those vehicles whose positions change over time and yet are moving at a speed of, for example, less than 5 mph (in other words, substantially slower than normal). Current approaches to measuring queue length at a roadway or intersection are done manually by a person watching the queue and deciding subjectively when vehicles have joined the back of the queue. Some people may make this decision when the vehicle comes to a stop and others when the vehicle is slowing down to stop. There is currently no systematic approach to dynamically measure the back of queue based on speed of the vehicle slowing down to enter the queue. Understanding how many vehicles are in queue to be serviced during a phase and the subsequent delay experienced by the vehicles in the queue is fundamental in signal timing to provide the correct amount of time for that phase and all the phases at the intersection. Because the current manual method is difficult, time-consuming, and inconsistent, queue length measurement is not commonly performed, leaving other less-precise intersection data to be used to optimize signal timing. Therefore, there remain inefficiencies in calculations of adjustments to signal timing, as there is no currently-available approach that accounts for delays caused by queues that involve dynamically measuring a length of a queue of vehicles at a roadway or intersection either by position or number of vehicles, and using the measured queue length to calculate vehicle delay over the course of time at either the roadway or traffic intersection where the queue is occurring, or at other roadways or traffic intersections within the same transportation network.

Accordingly, there is a need in the existing art for improvements in intersection traffic flow by dynamically measuring queue length for both position and number of vehicles, calculating vehicle delay at a traffic intersection and incorporating this information into traffic flow decision-making for making real-time adjustments to phase timing of traffic signals and for the evaluation of the effectiveness of the existing timing.

BRIEF SUMMARY OF THE INVENTION

In transportation environments that involve signalized roadways and intersections, when a traffic signal changes from green to yellow and then finally to red, a queue of traffic begins to build in each lane of the roadway as it waits for the next signal change. For efficient traffic signal operation, the green phase time should typically be, at a minimum, long enough to ensure that all vehicles depart the approach. Where the green time is set too short, unserviced vehicles will form a queue of traffic at the end of the phase. Similarly, if the green time is set too long, then the intersection may also become inefficient while vehicles are waiting to be serviced and queuing on other phases. Over time, queues will grow and congestion will occur.

Queue length and congestion directly relate to vehicular delay. Data representing vehicle delay may be used to measure the efficiency and effectiveness of traffic engineering and planning activities. Vehicle queueing, and the resulting impact on delay, are important measures of effectiveness when analyzing performance at signalized intersections. Estimates of vehicle queues are needed to determine the amount of time required for vehicles on an approach to be serviced, for vehicles in turn lanes to not spill out into thru traffic lanes, and to determine whether spillover occurs at upstream facilities (driveways, unsignalized intersections, signalized intersections, etc.). Approaches that experience extensive queues also are likely to experience an overrepresentation of rear-end collisions. Therefore, solving traffic congestion problems that result from queuing and delay are important considerations when assessing the level of service provided by the transportation infrastructure.

The present invention provides a framework for precision traffic analysis and for enhanced traffic signal control in transportation environments. This precision traffic analysis framework is provided in one or more systems and methods for increasing traffic flow efficiency based on measuring a length of one or more traffic queues and calculating a vehicle delay based on queue lengths to provide optimized phase timings for the intersection. This precision traffic analysis framework identifies a field of view within a traffic detection area at or near an observed roadway or traffic intersection and detects objects from sensors configured to monitor the traffic detection area that are located in or proximate to the observed roadway or traffic intersection. In one embodiment, queue length measured either by position (in terms of total length of the traffic queue per lane) or number of vehicles and speed of these objects are then evaluated to determine how many vehicles will need to be serviced during the programmed phase time and determine the amount of delay experienced by the vehicles in queue. In another embodiment, position (in terms of total length of the traffic queue per lane) and speed of these objects are then evaluated relative to either posted speeds or average estimated speeds or both, and to lapsed phase times for the traffic signal which they are approaching, for a determination of whether the queue length is normal, i.e., within expected temporal parameters based on time of day and day of week. In both embodiments, the precision traffic analysis framework then determines whether to adjust the phase timing and generates an output to a traffic signal controller accordingly.

It is therefore one objective of the present invention to provide systems and methods of assessing a traffic queue length for each lane of traffic in a roadway or traffic intersection comprising a transportation environment. It is another objective of the present invention to provide systems of methods of assessing such queue length in relation to known information for that particular roadway or traffic intersection, based upon on identifying multiple objects in a field of view of the roadway or intersection, and measurement of their speed, distance and position within a traffic detection area. It is another objective of the present invention to calculate a vehicular delay that results from the queue length for the roadway or traffic intersection.

It is still a further objective to estimate the required phase time to service queued vehicles. It is yet a further objective to provide a dynamic output to a traffic signal controller to adjust phase times and aid in operational efficiency based on queue length activity and the resulting vehicular delay.

Other objects, embodiments, features and advantages of the present invention will become apparent from the following description of the embodiments, taken together with the accompanying drawings, which illustrate, by way of example, the principles of the invention.

BRIEF DESCRIPTION OF THE SEVERAL VIEWS OF THE DRAWINGS

The accompanying drawings, which are incorporated in and constitute a part of this specification, illustrate several embodiments of the invention and together with the description, serve to explain the principles of the invention.

FIG. 1 is a systemic diagram illustrating elements of a precision traffic analytics framework according to the present invention;

DETAILED DESCRIPTION OF THE INVENTION

Figure 2:
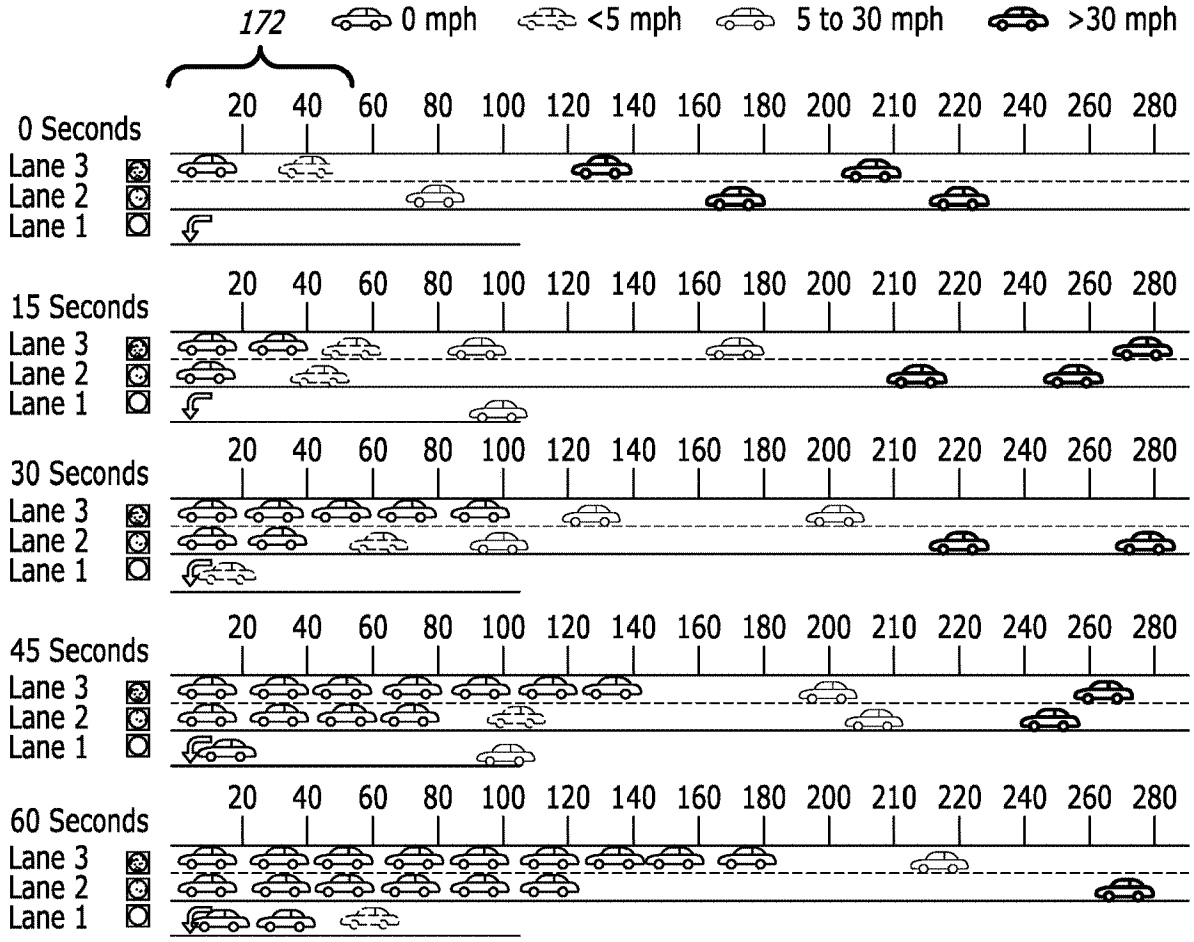
FIG. 2 is a diagram showing an exemplary illustration of how a position and speed of an object may be used to estimate an estimate vehicle queue length and produce a more accurate calculation of instantaneous vehicle-seconds of delay, according to one aspect of the present invention.

In the following description of the present invention, reference is made to the exemplary embodiments illustrating the principles of the present invention and how it is practiced. Other embodiments will be utilized to practice the present invention and structural and functional changes will be made thereto without departing from the scope of the present invention.

The present invention, as noted above, provides a precision traffic analysis framework 100 that is embodied in one or more systems and methods for observing and measuring an estimated traffic queue length 172 at a particular location 134 in a transportation network 102, and estimating resulting vehicle-seconds of delay 174 to assess performance of the transportation network 102. The precision traffic analysis framework 100 analyzes data derived from one or more capturing sensors 120 deployed at, near, within, or proximate to a roadway 104 or traffic intersection 106 within the transportation network 102 and applies outcomes from observing and measuring the estimated traffic queue length 172 and calculating resulting vehicle-seconds of delay 174 to improve traffic control systems and traffic flow efficiency.

FIG. 1 shows a system diagram of the precision traffic analytics framework 100. Input data 110 in the form of sensor data 112 and captured by one or more sensors 120 is processed to detect, classify, and characterize objects 113 within a field of view 114 for further traffic network analytics within the precision traffic analytics framework 100. The precision traffic analytics framework 100 is performed within one or more systems and/or methods that includes several components, each of which define distinct activities and functions for processing input data 110 from different types of sensors 120, for accurately detecting, identifying, and characterizing the objects 113, and for performing various mathematical calculations and models to ascertain and estimate vehicle queue length 172 and the resulting vehicle-seconds of delay 174 for assessing performance of a transportation network 102.

The precision traffic analytics framework 100 ingests, receives, requests, or otherwise obtains input data 110 obtained from one or more capturing sensors 120 that are part of a traffic detection system(s) 115. Such capturing sensors 120 may be positioned in or near a roadway 104 or traffic intersection 106, for example proximate to a traffic signal 107 and/or coupled to a traffic signal controller, and may include ranging or radar systems 121, imaging systems 122 such as cameras (including RGB, video, or thermal cameras), magnetometers 123, acoustic sensors 124, loops 125, ultrasonic sensors 126, piezoelectric sensors 127, air pressure tubes 128, and any other sensors, devices or systems 129 which are capable of detecting a presence of objects 113 within a transportation network 102. For example, sensors 120 may further include light-based (such as ultraviolet, visible, or infrared light) or laser-based sensing systems, such as LiDAR. It is to be understood that any combination of such sensors 120 may be used to detect objects 113 within a traffic detection system 115.

Input data 110 may also include other traffic data elements that represent traffic or object-related information pertaining to an observed roadway 104 or observed traffic intersection 106, which may or may not be provided by or derived from sensor data 112 collected by the one or more capturing sensors 120. For example, input data 110 may include speed data 116 for the roadway 104 or traffic intersection 106, such as a posted speed limit, or an average, estimated, or a currently-observed speed. This type of information may be maintained and provided by a traffic signal controller, or supplied by $3^{rd}$ party providers, and may be the product of surveys, taken over time, of actual roadway usage. Alternatively, such speed data 116 may also be derived from the sensor data 112, (for example, an average estimated speed or current estimated speed for all vehicular objects 113 for the observed roadway 104 or traffic intersection 106.)

Input data 110 may also include traffic signal and intersection data 117. This may include, for example, data provided by a traffic signal controller (such as information identifying the traffic signal controller) and a location 108 at which the traffic signal 107 and/or an associated traffic signal controller is configured (or where the roadway 104 or traffic intersection 106 is located). This may be represented as the latitude and longitude (positional coordinates) of the roadway 104 or traffic intersection 106 and any other relevant geometric or geographical information for the particular location 108 and may be provided by data points collected by one or more satellite-based radio-navigation systems, such as for example data points collected by global positioning system (OPS) systems and associated components thereof. Traffic signal and intersection data 117 may also identify the approaches at a particular intersection 106, the number lanes at each approach, the type of roadway 104 or intersection 106, and any other information identifying a configuration of the roadway 104 or intersection 106.

The input data 110 may further include signal and phase timing data 118. This may include an identification of a current phase and a lapsed time of the current phase. The signal and phase timing data 118 may also identify the set of timing plans currently configured at the traffic intersection 106 and/or traffic signal 107 and any associated information such as split times, cycle length, offset, and sequence. Other information may include a schedule for switching from one set of timing plans to another.

Input data 110 is applied to a plurality of data processing elements 134 in the precision traffic analytics framework 100 that are components within a computing environment 130 that also includes one or more processors 132 and a plurality of software and hardware components. The one or more processors 132 and plurality of software and hardware components are configured to execute program instructions or routines to perform the mathematical functions, algorithms, machine learning, and other analytical approaches comprising the data processing functions described herein and embodied within the plurality of data processing elements 134.

The plurality of data processing elements 134 include a data ingest and initialization element 140 that is configured to ingest, receive, request, or otherwise obtain the input data 110 as noted above, and initialize the input data 110 for further processing within the precision traffic analytics framework 100. The plurality of data processing elements 134 also include a traffic detection area element 150, configured to execute one or more algorithms that identify a traffic detection area on the observed roadway 104, for example by examining attributes of sensor data 112 to define a plurality of traffic lanes 152 within a field of view 114 of least one (capturing) sensor 120, within which objects 113 are to be identified and characterized.

The traffic detection area element 150 is also configured to identify 154 which phases are active and current phase timing at the one or more traffic signals 107. This information may be requested from or obtained from, for example, a traffic signal controller, or requested from or obtained from an external system or third party; regardless, such active phase and signal timing 118 may be identified from, and included within, timing plan information of the traffic signal and intersection data 117.

The plurality of data processing elements 134 further include an object identification and characterization element 160 that is configured to execute one or more algorithms to analyze information collected by the capturing sensor(s) 120 to identify 162 vehicular objects 113 within a traffic lane and calculate a speed and a location 164 of each vehicular object 113 within the traffic lane, in preparation for subsequent processing in an optimization and analysis element 170.

Figure 3:
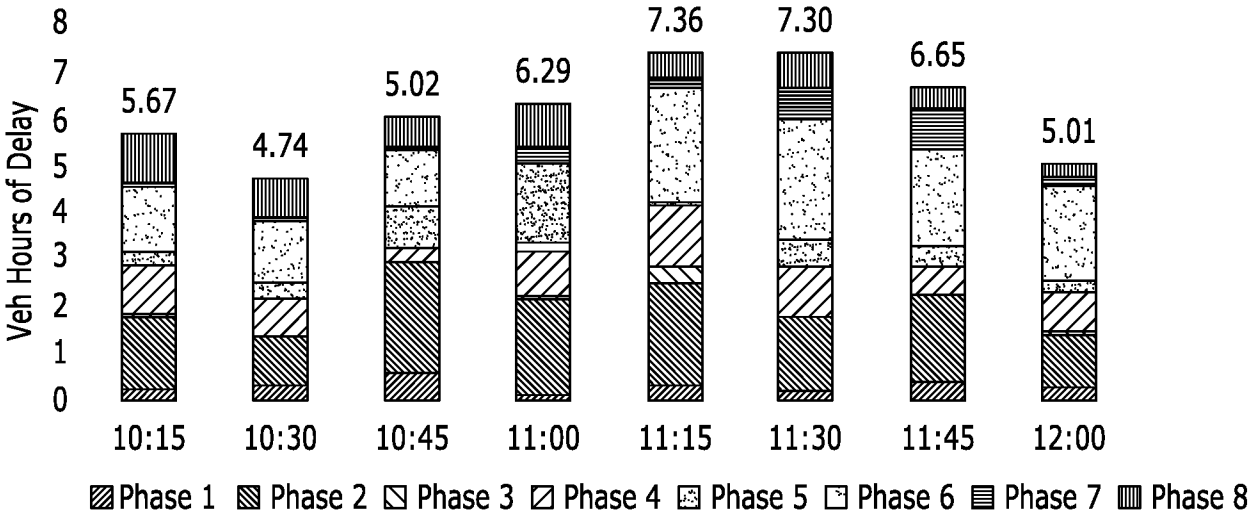
FIG. 3 is a diagram showing an exemplary illustration of how instantaneous vehicle-seconds of delay is utilized to calculate vehicle-hours of delay by phase across an entire traffic intersection, according to another aspect of the present invention.
Figure 4:
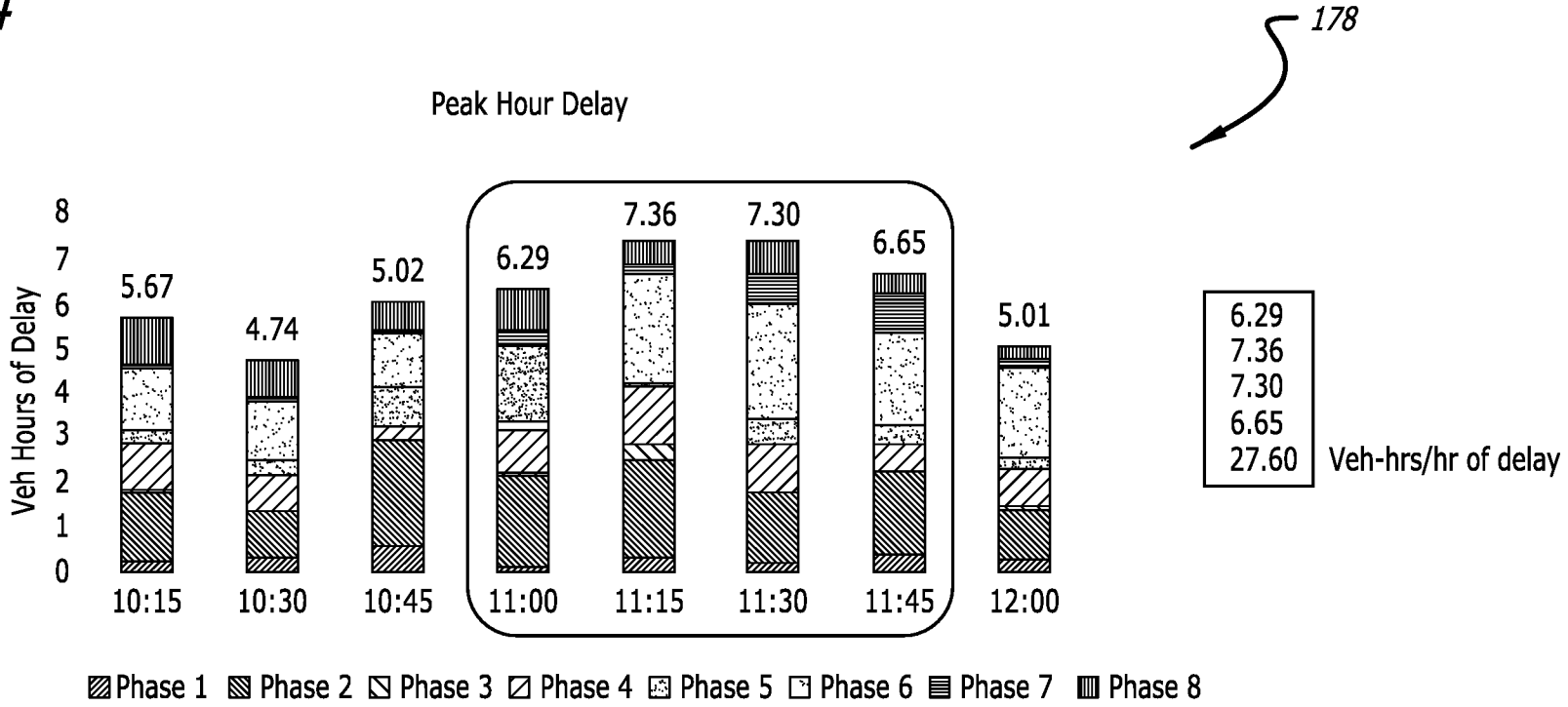
FIG. 4 is a diagram showing an exemplary illustration of how vehicle-hours of delay are utilized to identify a peak vehicle delay per hour, according to a further aspect of the present invention.

The optimization and analysis element 170 is configured to estimate a vehicle queue length 172 and uses this estimated queue length 172 to calculate instantaneous vehicle-seconds of delay 174, as discussed further herein with regard to FIG. 2. The optimization and analysis element 170 is further configured to derive vehicle-hours of delay 176 based on the instantaneous vehicle-seconds of delay 174, as discussed further herein with regard to FIG. 3. The optimization and analysis element 170 then applies this information to calculate a peak delay per hour 178 for each approach to the one or more traffic signals 107 as illustrated in FIG. 4 and discussed in further detail below.

FIG. 2 is a diagram illustrating an example of how a position and speed of an object 113 may be used to estimate an estimate vehicle queue length 172 and produce a more accurate calculation of instantaneous vehicle-seconds of delay 174. The object identification and characterization element 160 first identifies vehicles 162 among the detected objects 113 in a field or fields of view 114 of at least one capturing sensor 120 and passes this information to the optimization and analysis element 170. The optimization and analysis element 170 calculates each vehicle's position and speed from the sensor data 112 and estimates vehicle queue length 172 based on one or both of the position and speed, by counting both stopped vehicles and slow-moving vehicles (for example, those moving less than a preset or default configurable value of <5 mph) within a particular distance from a fixed location, for example the stop bar at the traffic intersection 106, or a specified distance from the capturing sensor 120. The precision traffic analytics framework 100 then normalizes the summed quantity of stopped and slow-moving vehicles to calculate the instantaneous vehicle-seconds of delay 174. In one embodiment, normalizing the summed quantity of queued vehicles, which includes stopped and slow-moving vehicles, may occur by multiplying the total number of queued vehicles by a chosen delay factor representing the measurement interval time between counts. For calculation purposes, it can be assumed that vehicles queued at the interval count were delayed for the duration of the interval. For example, if the chosen measurement interval time is 15 seconds, multiplying the number of queued vehicles at the 15 second interval would result in the vehicle-seconds of delay that occurred for that interval. Summing the vehicle-seconds of delay for all intervals in a time period would result in the delay for that period in the optimization and analysis element 170. In another embodiment, a value representing time delay for those stopped and slow-moving vehicles needed to resume a speed that is nearer to either an average speed, an estimated speed, or a posted speed for that particular approach is based on the speed of free-flowing traffic and one or both of the speed of each identified vehicle, and its position relative to the fixed location.

The above calculation of instantaneous vehicle-seconds of delay 174 represents a true delay occurring from, and factored by as noted above, vehicles that are moving at a speed below that of free-flowing traffic. Alternatively, the optimization and analysis element 170 may calculate instantaneous vehicle-seconds of delay 174 representing a simplified delay that is based only on the quantity of stopped vehicles as a measurement of vehicle queue length 172, according to another embodiment of the present invention. The precision traffic analytics framework 100 may therefore calculate, in accordance with one embodiment of the present invention, a delay associated with these vehicles by multiplying the number of vehicles stopped by a length of time stopped.

Regardless, the instantaneous vehicle-seconds of delay 174 may then be extrapolated to vehicle-hours of delay 176 for the whole intersection. FIG. 3 illustrates how the precision traffic analysis framework 100 uses instantaneous vehicle-seconds of delay 174 to calculate vehicle-hours of delay by phase across an entire traffic intersection 106. Vehicle-hours of delay 176 for a single lane are calculated by accumulating the instantaneous vehicle-seconds of delay 174 for each lane over a specified time period, for example a 15-minute period. By aggregating the delay for all lanes associated with each phase, the vehicles-hours of delay per phase can be calculated for all approaches of the traffic intersection 106. This resulting vehicle-seconds of delay is divided by the number of seconds in an hour to quantify the hourly delay calculation for the for each phase of a traffic signal controller for a traffic signal 107. The hourly delay for each phase can be aggregated for all phases for the entire traffic intersection 106 to calculate an intersection delay value.

This data can then be analyzed to identify a peak vehicle delay per hour 178 as illustrated in FIG. 4. The precision traffic analytics framework 100 calculates the peak vehicle delay per hour 178 by summing consecutive bins of vehicle-hours of delay that combine to make up one hour. The precision traffic analysis framework 100 sums the first set of consecutive bins of vehicle delay, then sums the second set of consecutive bins starting with the $2^{nd}$ bin, and repeats this process starting with the $3^{rd}$ bin, then the $4^{th}$, and so on. The summed consecutive bins that total an hour with the highest total is the peak vehicle delay hour 178. This hour is the hour that traffic engineers and transportation infrastructure managers are most interested in identifying, as reducing delay and queue length for this hour improves performance and efficiency of the traffic intersection 106 and the entire affiliated and connected transportation network 102.

Returning to FIG. 1, the data processing elements 134 also include a traffic signal timing element 180, configured to generate instructions 182 to adjust phase timing 192 of the one or more traffic signals 107 based on estimated queue length 172 and delay. The traffic signal timing element 180 transmits these instructions 182 to a traffic signal controller 191 for the one or more traffic signals 107 to provide timing to the traffic signal controller 191, as output data 190 of the precision traffic analytics framework 100. Conversely, third party systems may also access the output data 190 to generate such instructions via one or more APIs, including third parties operating such traffic signal controllers.

Output data 190 may take many different forms, in addition to providing signals relative to instructions 182 for a traffic signal controller 191 to adjust a phase timing 192. The output data 190 may also include sensor calibration 193, and the present invention may be configured to either communicate with sensors 120 to perform calibrations thereof (for example, where it is determined that fields of view 114 are being erroneously defined), or enable third party systems to calibrate sensors 120, again via one or more APIs, by obtaining the output data 190 and determining whether such sensors 120 are in need of adjustment.

The output data 190 may also include signals and/or instructions to adjust queue length thresholds 194. For example, the precision traffic analytics framework 100 may determine that an adjustment is needed to the speed threshold to change the counting both stopped vehicles and slow-moving vehicles. Alternatively, or additionally, an adjustment may be made regarding the distance from a fixed location for counting such stopped and slow-moving vehicles, for example by extending or shortening a specified distance from stop bar, or the specified distance from the capturing sensor 120. The output data 190 may further include the traffic queue length 195 itself either in the form of position or number of vehicles, which may be provided to internal or external systems, again, for example, via one or more APIs, for further traffic analytics.

Output data 190 may also include a classification 195 of one or more objects 114 detected by the object identification and characterization element 160. Such an object classification 191 may be performed by one or more algorithms that are capable of differentiating between types of objects or vehicles, such as those that analyze pixel characteristics and attributes in images collected by radar systems 121 or imaging systems 122. For example, objects 113 may be classified by associating groups of moving pixels having common pixel characteristics in an analysis of the "whole scene" of the field of view 114 to distinguish between foreground objects and background objects. In such an example, the object identification and characterization element 160 of the precision traffic analytics framework 100 may process temporal information discerned from a traffic detection area to analyze the foreground of the field of view 114, and process spatial information discerned from the traffic detection system 115 to learn a detection zone background model. Object types may be identified based on dominant object type features that include pixel intensity, edges, texture content, shape, object attributes, and object tracking attributes for each object type.

Output data 190 may also include a count 196 of each of the one or more objects 113 at a roadway 104 or traffic intersection 106, or traffic signal 107. Still further, the calculated location and speed 164, and any trajectory calculated for each object 113, in each lane of the roadway 104 or traffic intersection 106, may also be generated as output data 190, and provided to internal or external systems (as noted above, via one or more APIs) for further traffic analytics.

Regardless of the type, output data 190 may enable functions such as traffic analytics and reporting and may be provided to one or more third party or external applications for additional analytics and processing therein, such as for example a traffic management system 197. Many other types of output data 190 are also possible and within the scope of the present invention, and may be configured many different use cases, including for example generating alarms, reports, and recommendations. Output data 190, regardless of the type, may be configured for display on a display interface.

Output data 190 may include an indicator, for example to a traffic management system 197, that a delay has exceeded a threshold delay time, or that a delay is above a pre-defined temporal level for a pre-defined for period of time. The precision traffic analytics framework 100 may therefore be configured to track delay and compare delay to pre-defined thresholds, and generate signals, instructions, or other indicators when thresholds have been exceeded.

The present invention may also include a traffic support tool 136, as discussed further herein, and such a tool 136 is one way that a user may view and interact with the precision traffic analytics framework 100 and configure various aspects thereof. For example, users may configure the precision traffic analytics framework 100 to adjust queue length thresholds, adjust or calibrate sensors 120, define custom fields of view 114, and generally manually adjust inputs to the precision traffic analytics framework 100. Additionally, output data 190 may be provided directly to the traffic support tool 136.

A user may configure and interact with the precision traffic analytics framework 100 using the traffic support tool 136 via an application resident on a computing device, such as a desktop, laptop, tablet, mobile, wearable, or other computer, and/or using a graphical user interface. The traffic support tool 136 may include widgets, drop-down menus, and other indicia presented via the application and graphical user interface that enable a user to make selections and perform functions attendant to operation of the precision traffic analytics framework 100.

Figure 5:
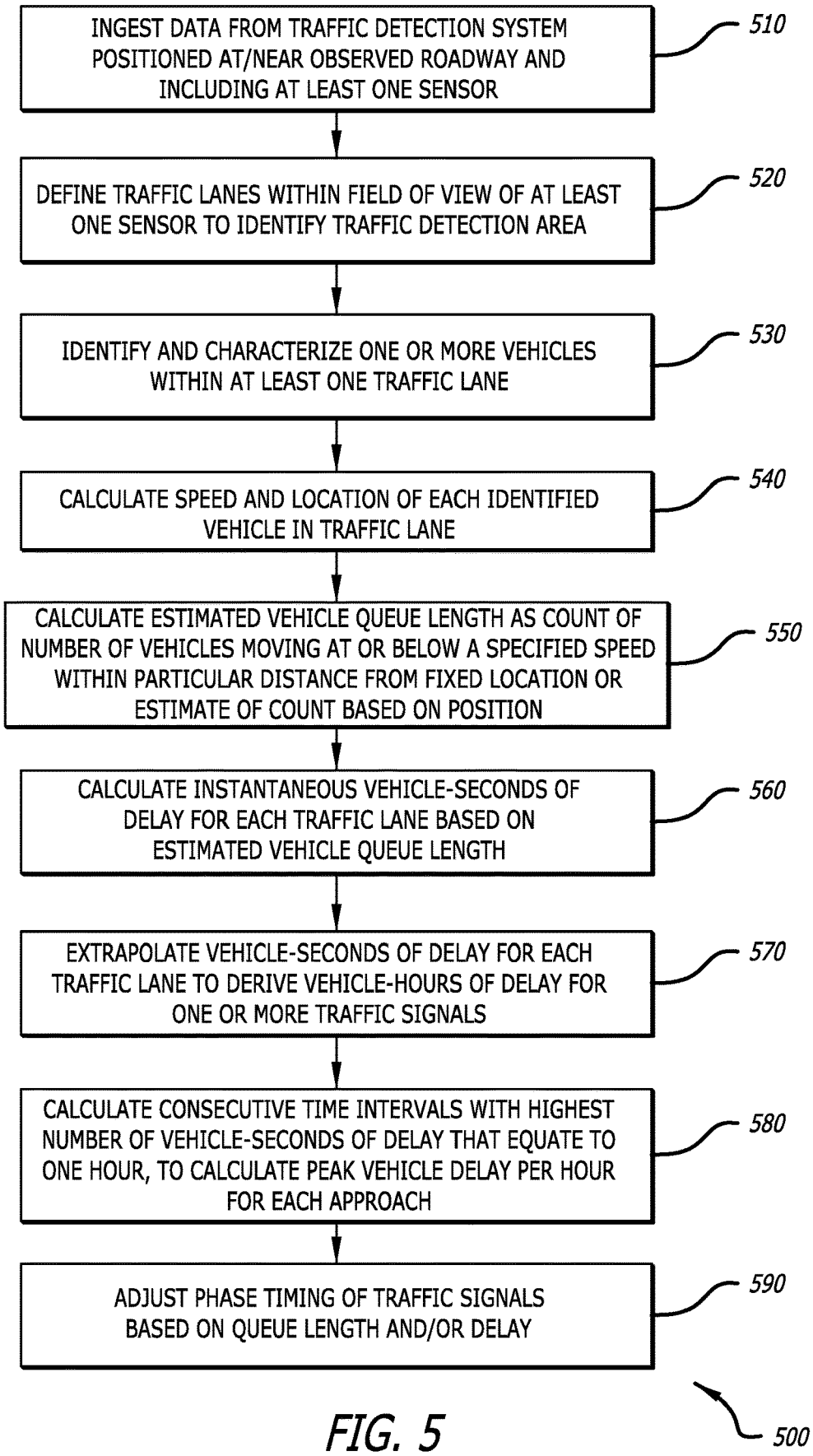
FIG. 5 is a flowchart of steps in a process of performing the precision traffic analytics framework according to one embodiment of the present invention.

FIG. 5 is a flowchart illustrating steps in a process 500 for performing the precision traffic analytics framework 100, according to one or more embodiments of the present invention. Such a process 500 may include, as noted above one or more functions, mathematical models, algorithms, machine learning processes, and data processing techniques for the data processing elements 134 within such a framework 100, and for the various functions of each element 134.

The process 500 is initialized at step 510 by ingesting input data 110 collected from a traffic detection system 115 that includes at least one capturing sensor 120 collecting information representing one or more objects 113 within a field of view 114 at or near an observed roadway 104 or traffic intersection 106. This information is communicated to the traffic detection area element 150 to define traffic lanes within the field of view 114 and identify a traffic detection area 115 at step 520. The process 500 may also identify the current phase status and timing and a lapsed cycle time within the traffic detection area element 150. The process 500 continues by identifying and characterizing objects 113 to ascertain that vehicles are within each traffic lane at step 530. Where objects 113 are characterized as vehicles, the process 500 calculates a speed and location of each identified vehicle in each traffic lane at step 540.

The process 500 then proceeds with calculating an estimated vehicle queue length 172 at step 550, by analyzing the vehicles characterized from the sensor data 112 to assess the number of vehicles that are either stopped or moving below a pre-set speed value within a particular pre-set distance from a fixed location in each traffic lane. The number of vehicles can also be estimated by knowing the distance that the farthest stopped or slow-moving vehicle is from the pre-set distance from a fixed location and estimating a standard number of vehicles for that distance. As noted above, the fixed location may be either a stop bar or a position of the capturing sensor 120, and therefore the particular pre-set distance may change depending on the fixed location and may be adjusted by the user (together with the pre-set speed value) by a user, for example, using the traffic support tool 136.

At step 560, the process 500 then calculates the instantaneous vehicle-seconds of delay 174 due to the estimated queue length 172. This occurs by normalizing the summed quantity or estimated quantity based on location of stopped and slow-moving vehicles, by multiplying the estimated queue length 172 by the estimated time that each queued vehicle was delayed. This estimated time, for example 15 seconds, can be the measurement interval where it is assumed that queued vehicles were delayed for the interval time or may represent an amount of time either that the stopped and slow-moving vehicles need to resume a speed that is nearer to either an average speed, an estimated speed, or a posted speed for that particular approach, or that other vehicles are expected to experience as delay as a result of the presence of stopped or slow-moving vehicles.

At step 570, the process 500 then extrapolates the instantaneous vehicle-seconds of delay 174 for each traffic lane to derive vehicle-hours of delay 176 for traffic signals 107 at each approach of the traffic intersection. This occurs by accumulating the vehicle-seconds of delay for each phase over a pre-set time period and aggregating the delay for all lanes and all phases on each approach of the traffic intersection 106. This resulting amount is divided by the number of seconds per hour to quantify instantaneous vehicle-seconds of delay and represent that delay as an hourly delay calculation for the entire traffic intersection 106 for each phase.

At step 580, the process 500 then calculates the highest hour of vehicle-hours of delay by analyzing consecutive time intervals that equate to one hour. The process 500 sums the first set of consecutive bins of vehicle delay that equate to one hour and repeats this analysis for each set of consecutive bins starting with the $2^{nd}$ bin, then the $3^{rd}$ bin, then the $4^{th}$, and so on. The summed hour of consecutive bins with the highest total produces the peak vehicle delay hour 178 for each approach to the traffic intersection 106.

The process 500 then applies the estimated queue length 172 calculated at step 550 and/or the vehicle-seconds of delay 174 calculated at step 560 and/or the peak vehicle delay hour 178 to adjust, where appropriate, a traffic signal controller 191 at step 590. The precision traffic analytics framework 100 generates one or more instructions 182 as noted above, for example to adjust or extend one or more of a phase timing 192 of traffic signals 107 at the traffic intersection 106. Additionally, the process 500 may apply the estimated queue length 172 and/or the vehicle-seconds of delay 174 and/or the peak vehicle delay hour 178 to adjust traffic signaling equipment such as traffic signal controllers 191 elsewhere within a transportation network 102, as queues and delays at one traffic intersection 106 may affect traffic conditions elsewhere within such a transportation network 102.

It is to be understood that the precision traffic analytics framework 100 may be realized with many variations, and in many different embodiments, and therefore many other implementations of the present invention are possible. For example, in a more simplified processing approach as noted above, the precision traffic analytics framework 100 may sum the estimated vehicle queue length 172 in each traffic lane to estimate a number of vehicles across all traffic lanes of approach to the one or more traffic signals 107 and adjust the phase timing where the number of vehicles across all lanes of the approach exceeds a threshold quantity of vehicles.

Alternatively, the precision traffic analytics framework 100 may sum, compare, the estimated vehicle queue length 172 in each traffic lane to a queue length that is sensor-related or sensor-derived, for example one that represents a maximum sensor limit based on a field of view(s) 114 of the capturing sensor(s) 120. The precision traffic analytics framework 100 may therefore adjust the phase timing where the estimated vehicle queue length 172 exceeds the maximum sensor limit (or other sensor-related or sensor-derived value). The threshold values, and sensor-related or sensor-derived values such as maximum sensor limits, may be pre-defined or pre-set, may automatically adjustable, and/or may be configurable by a user, for example using the traffic support tool 136.

Additionally, instead of utilizing a single estimated vehicle queue length 172, the precision traffic analytics framework 100 may utilize multiple estimated vehicle queue lengths 172 based on identified vehicle types. Still further the estimated vehicle queue length 172 may be measured only during a particular signal indication type or a combination of signal indications, for example during a red signal indication.

The systems and methods of the present invention may be implemented in many different computing environments 130. For example, they may be implemented in conjunction with a special purpose computer, a programmed microprocessor or microcontroller and peripheral integrated circuit element(s), an ASIC or other integrated circuit, a digital signal processor, electronic or logic circuitry such as discrete element circuit, a programmable logic device or gate array such as a PLD, PLA, FPGA, PAL, GPU and any comparable means. Still further, the present invention may be implemented in cloud-based data processing environments, and where one or more types of servers are used to process large amounts of data, and using processing components such as CPUs, GPUs, TPUs, and other similar hardware. In general, any means of implementing the methodology illustrated herein can be used to implement the various aspects of the present invention. Exemplary hardware that can be used for the present invention includes computers, handheld devices, telephones (e.g., cellular, Internet enabled, digital, analog, hybrids, and others), and other such hardware. Some of these devices include processors (e.g., a single or multiple microprocessors or general processing units), memory, nonvolatile storage, input devices, and output devices. Furthermore, alternative software implementations including, but not limited to, distributed processing, parallel processing, or virtual machine processing can also be configured to perform the methods described herein.

The systems and methods of the present invention may also be wholly or partially implemented in software that can be stored on a non-transitory computer-readable storage medium, executed on programmed general-purpose computer with the cooperation of a controller and memory, a special purpose computer, a microprocessor, or the like. In these instances, the systems and methods of this invention can be implemented as a program embedded on a mobile device or personal computer through such mediums as an applet, JAVA® or CGI script, as a resource residing on one or more servers or computer workstations, as a routine embedded in a dedicated measurement system, system component, or the like. The system can also be implemented by physically incorporating the system and/or method into a software and/or hardware system.

Additionally, the data processing functions disclosed herein may be performed by one or more program instructions stored in or executed by such memory, and further may be performed by one or more modules configured to carry out those program instructions. Modules are intended to refer to any known or later developed hardware, software, firmware, machine learning, artificial intelligence, fuzzy logic, expert system or combination of hardware and software that is capable of performing the data processing functionality described herein.

The foregoing descriptions of embodiments of the present invention have been presented for the purposes of illustration and description. It is not intended to be exhaustive or to limit the invention to the precise forms disclosed. Accordingly, many alterations, modifications and variations are possible in light of the above teachings, may be made by those having ordinary skill in the art without departing from the spirit and scope of the invention. For example, instead of utilizing a single estimated vehicle queue length, the precision traffic analytics framework 100 may calculate multiple estimated lengths, based on different identified vehicle or object types, and model instantaneous vehicle seconds of delay 174 (and resulting vehicle hours of delay 176 and peak vehicle delay per hour 178) by each type of object 113 detected. Still further, the precision traffic analytics framework 100 may estimate queue length during a red signal phase only and may only estimate queue length based on actual stopped vehicles. It is therefore intended that the scope of the invention be limited not by this detailed description. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

The invention claimed is:

1. A method for measuring delay at a traffic signal from vehicle queue length, comprising:

receiving, as input data, information collected by a traffic detection system comprised of at least one sensor positioned at an observed roadway proximate to one or more traffic signals;

analyzing the input data in a plurality of data processing elements within a computing environment that includes one or more processors and at least one computer-readable non-transitory storage medium having program instructions stored therein which, when executed by the one or more processors, cause the one or more processors to execute the plurality of data processing elements to measure delay at the one or more traffic signals from an estimated vehicle queue length, by:

identifying a traffic detection area on the observed roadway, by defining a plurality of traffic lanes within a field of view of the at least one sensor, identifying one or more vehicles within at least one traffic lane in the plurality of traffic lanes, calculating one or both of a speed of each identified vehicle in the at least one traffic lane, and a position of each identified vehicle within the at least one traffic lane, calculating the estimated vehicle queue length representing a count of the number of vehicles in the at least one traffic lane moving at or below a specified speed within a particular distance from a fixed location in each traffic lane, calculating an instantaneous vehicle-seconds of delay for each traffic lane based on the estimated vehicle queue length, by multiplying the estimated vehicle queue length by a factored vehicle delay, and extrapolating the vehicle-seconds of delay for each traffic lane to derive vehicle-hours of delay for the one or more traffic signals, to calculate a peak vehicle delay per hour for each approach to the one or more traffic signals; and adjusting a phase timing of the one or more traffic signals based on one or both of the estimated vehicle queue length and the peak vehicle delay per hour.

2. The method of claim 1, wherein the adjusting the phase timing further comprises generating one or more instructions to adjust the phase timing, and transmitting the one or more instructions to a traffic signal controller for the one or more traffic signals.

3. The method of claim 1, wherein the factored vehicle delay is a measurement interval time.

4. The method of claim 1, wherein the specified speed is a default value of 5 miles per hour, and wherein the particular distance from a fixed location in each traffic lane is either a distance from the stop bar or a distance from the at least one sensor.

5. The method of claim 1, wherein the identifying one or more vehicles further comprises detecting one or more objects within at the least one traffic lane in the plurality of traffic lanes and classifying each object to determine whether the one or more objects represent vehicles approaching the fixed location in each traffic lane, and further wherein the fixed location is a stop bar.

6. The method of claim 1, wherein the identifying one or more vehicles further comprises detecting one or more objects within at the least one traffic lane in the plurality of traffic lanes and classifying each object to determine whether the one or more objects represent vehicles within a particular distance of the fixed location in each traffic lane, and further wherein the fixed location is a position of the at least one sensor.

7. The method of claim 1, wherein the calculating a location of each identified vehicle within the at least one traffic lane further comprises calculating a distance from the fixed location, the fixed location representing either the at least one sensor, or a stop bar in the at least one traffic lane.

8. The method of claim 1, further comprising continuously updating at least the identification of objects and calculation of speed of each vehicle, and calculating of the location of each vehicle, as sensor data is captured by the at least one sensor.

9. The method of claim 1, further comprising correlating the calculated speed to one or both of posted speed limit or an average speed for the distance from the fixed location and an amount of lapsed time in a current phase, to characterize the speed of vehicle relative to expected roadway parameters representing a normal speed for one or more of the amount of lapsed time, a current time of day, and a current day of the week, and comparing the number of vehicles in each traffic lane for each phase cycle to the expected roadway parameters to assess whether the vehicle-seconds of delay is exceeds an expected delay based on the expected roadway parameters.

10. The method of claim 1, further comprising determining a quantity of vehicles to move through the traffic signal during a programmed phase time, determining an amount of delay experienced by the quantity of vehicles, and updating the phase timing to allow the quantity of vehicles to pass through the traffic signal.

11. A method for measuring delay at a traffic signal from vehicle queue length, comprising:

defining a plurality of traffic lanes within a field of view of at least one sensor positioned at an observed roadway proximate to one or more traffic signals;

analyzing information collected by the at least one sensor to identify one or more vehicles within at least one traffic lane in the plurality of traffic lanes, calculate a speed of each identified vehicle in the at least one traffic lane, and calculate a location of each identified vehicle within the at least one traffic lane;

calculating a peak vehicle delay per hour for each approach to the one or more traffic signals, by 1) estimating a vehicle queue length representing a count of the number of vehicles in the at least one traffic lane moving at or below a specified speed within a particular distance from a fixed location in each traffic lane, 2) computing an instantaneous vehicle-seconds of delay for each traffic lane based on the vehicle queue length, by multiplying the vehicle queue length by a factored vehicle delay, and 3) extrapolating the vehicle-seconds of delay for each traffic lane to derive vehicle-hours of delay for the one or more traffic signals; and adjusting a phase timing of the one or more traffic signals based on one or both of the estimated vehicle queue length and the peak vehicle delay per hour.

12. The method of claim 11, wherein the adjusting the phase timing further comprises generating one or more instructions to adjust the phase timing, and transmitting the one or more instructions to a traffic signal controller for the one or more traffic signals.

13. The method of claim 11, wherein the factored vehicle delay is a measurement interval time.

14. The method of claim 11, wherein the specified speed is a default value of 5 miles per hour, and wherein the particular distance from a fixed location in each traffic lane is either a distance from the stop bar or a distance from the at least one sensor.

15. The method of claim 11, wherein the identifying one or more vehicles further comprises detecting one or more objects within at the least one traffic lane in the plurality of traffic lanes and classifying each object to determine whether the one or more objects represent vehicles approaching the fixed location in each traffic lane, and further wherein the fixed location is a stop bar.

16. The method of claim 11, wherein the identifying one or more vehicles further comprises detecting one or more objects within at the least one traffic lane in the plurality of traffic lanes and classifying each object to determine whether the one or more objects represent vehicles within a particular distance of the fixed location in each traffic lane, and further wherein the fixed location is a position of the at least one sensor.

17. The method of claim 11, wherein the calculating a location of each identified vehicle within the at least one traffic lane further comprises calculating a distance from the fixed location, the fixed location representing either the at least one sensor, or a stop bar in the at least one traffic lane.

18. The method of claim 11, further comprising continuously updating at least the identification of objects and calculation of speed of each vehicle, and calculating of the location of each vehicle, as sensor data is captured by the at least one sensor.

19. The method of claim 11, further comprising correlating the calculated speed to one or both of posted speed limit or an average speed for the distance from the fixed location and an amount of lapsed time in a current phase cycle, to characterize the speed of vehicle relative to expected roadway parameters representing a normal speed for one or more of the amount of lapsed time, a current time of day, and a current day of the week, and comparing the number of vehicles in each traffic lane for each phase cycle to the expected roadway parameters to assess whether the vehicle-seconds of delay is exceeds an expected delay based on the expected roadway parameters.

20. The method of claim 11, further comprising determining a quantity of vehicles to move through the traffic signal during a programmed phase time, determining an amount of delay experienced by the quantity of vehicles, and updating the phase timing to allow the quantity of vehicles to pass through the traffic signal.

21. A system for measuring delay at a traffic signal from vehicle queue length, comprising:

a data collection element configured to receive input data comprised of information collected by a traffic detection system comprised of at least one sensor positioned at an observed roadway proximate to one or more traffic signals;

a traffic detection area identification element, configured to identify a traffic detection area on the observed roadway, by defining a plurality of traffic lanes within a field of view of the at least one sensor;

an object identification and characterization element, configured to analyze information collected by the at least one sensor to identify one or more vehicles within at least one traffic lane in the plurality of traffic lanes, calculate a speed of each identified vehicle in the at least one traffic lane, and calculate a location of each identified vehicle within the at least one traffic lane;

an optimization and analysis element, configured to calculate a peak vehicle delay per hour for each approach to the one or more traffic signals, by 1) estimating a vehicle queue length representing a count of the number of vehicles in the at least one traffic lane moving at or below a specified speed within a particular distance from a fixed location in each traffic lane, 2) computing an instantaneous vehicle-seconds of delay for each traffic lane based on the vehicle queue length, by multiplying the vehicle queue length by a factored vehicle delay, and 3) extrapolating the vehicle-seconds of delay for each traffic lane to derive vehicle-hours of delay for the one or more traffic signals; and a traffic signal timing element, configured to generate one or more instructions to adjust a phase timing of the one or more traffic signals based on one or both of the estimated vehicle queue length and the peak vehicle delay per hour, and transmit the one or more instructions to a traffic signal controller for the one or more traffic signals.

22. The system of claim 21, wherein the factored vehicle delay is a measurement time interval.

23. The system of claim 21, wherein the specified speed is a default value of 5 miles per hour, and wherein the particular distance from a fixed location in each traffic lane is either a distance from the stop bar or a distance from the at least one sensor.

24. The system of claim 21, wherein the object identification and characterization element is further configured to detect one or more objects within at the least one traffic lane in the plurality of traffic lanes, and classify each object to determine whether the one or more objects represent vehicles approaching the fixed location in each traffic lane, and further wherein the fixed location is a stop bar.

25. The system of claim 21, wherein the object identification and characterization element is further configured to detect one or more objects within at the least one traffic lane in the plurality of traffic lanes, and classify each object to determine whether the one or more objects represent vehicles within a particular distance of the fixed location in each traffic lane, and further wherein the fixed location is a position of the at least one sensor.

26. The system of claim 21, wherein the object identification and characterization element is further configured to calculate a distance from the fixed location, the fixed location representing either the at least one sensor, or a stop bar in the at least one traffic lane.

27. The system of claim 21, wherein the identification of objects, calculation of the speed of each vehicle, and calculation of the location of each vehicle is continually updated as sensor data is captured by the at least one sensor.

28. The system of claim 21, wherein the optimization and analysis element is further configured to correlate the calculated speed to one or both of posted speed limit or an average speed for the distance from the fixed location and an amount of lapsed time in a current phase cycle, to characterize the speed of vehicle relative to expected roadway parameters representing a normal speed for one or more of the amount of lapsed time, a current time of day, and a current day of the week, and compare the number of vehicles in each traffic lane for each phase cycle to the expected roadway parameters to assess whether the vehicle-seconds of delay is exceeds an expected delay based on the expected roadway parameters.

29. The system of claim 21, wherein the optimization and analysis element is further configured to determine a quantity of vehicles to move through the traffic signal during a programmed phase time, determine an amount of delay experienced by the quantity of vehicles, and wherein the traffic signal timing element is further configured to update the phase timing to allow the quantity of vehicles to pass through the traffic signal.

* * * * *